US009258856B2

(12) United States Patent
Han et al.

(10) Patent No.: US 9,258,856 B2
(45) Date of Patent: Feb. 9, 2016

(54) LIGHT EMITTING DIODE POWER SUPPLY APPARATUS

(71) Applicant: SAMSUNG ELECTRO-MECHANICS CO., LTD., Suwon, Gyunggi-do (KR)

(72) Inventors: Dae Hoon Han, Suwon (KR); Seo Hyung Kim, Suwon (KR); Jung Sun Kwon, Suwon (KR); Jung Eui Park, Suwon (KR); Jin Soo Lee, Suwon (KR); Bo Hyun Hwang, Suwon (KR)

(73) Assignee: SAMSUNG ELECTRO-MECHANICS CO., LTD., Suwon-Si, Gyeonggi-Do (KR)

( * ) Notice: Subject to any disclaimer, the term of this patent is extended or adjusted under 35 U.S.C. 154(b) by 122 days.

(21) Appl. No.: 14/029,386

(22) Filed: Sep. 17, 2013

(65) Prior Publication Data

US 2015/0002050 A1 Jan. 1, 2015

(30) Foreign Application Priority Data

Jun. 28, 2013 (KR) ..... 10-2013-0076009

(51) Int. Cl.
*H05B 33/08* (2006.01)

(52) U.S. Cl.
CPC ..... *H05B 33/0815* (2013.01); *H05B 33/0824* (2013.01); *H05B 33/0887* (2013.01)

(58) Field of Classification Search
CPC .... H05B 37/02; H05B 33/08; H05B 33/0815; H05B 33/0824; H05B 33/0851; H05B 33/0874; H05B 33/0887
USPC ..... 315/201, 205, 206, 219, 279, 291, 297, 315/307, 308
See application file for complete search history.

(56) References Cited

U.S. PATENT DOCUMENTS

2010/0220049 A1* 9/2010 Murakami ..... 345/102
2011/0260631 A1* 10/2011 Park et al. ..... 315/165
2012/0068614 A1* 3/2012 Ng et al. ..... 315/185 R

FOREIGN PATENT DOCUMENTS

KR 10-2008-0007751 A 1/2008
KR 10-2009-0079097 A 7/2009
KR 10-2012-0031215 A 3/2012

* cited by examiner

*Primary Examiner* — Thai Pham
(74) *Attorney, Agent, or Firm* — McDermott Will & Emery LLP

(57) ABSTRACT

There is provided a light emitting diode power supply apparatus capable of limiting a rise in a voltage level of a power supplied to a light emitting diode even in the case in which driving of the light emitting diode is stopped for a long period of time. The light emitting diode power supply apparatus includes: a power supply unit supplying a driving power set under a control to a light emitting diode; and a controlling unit selecting one of a detection voltage obtained by detecting a current flowing to the light emitting diode and a voltage provided according to an operation state of the light emitting diode to control a power supply operation of the power supply unit.

25 Claims, 7 Drawing Sheets

LIGHT EMITTING DIODE POWER SUPPLY APPARATUS

CROSS-REFERENCE TO RELATED APPLICATIONS

This application claims the priority of Korean Patent Application No. 10-2013-0076009 filed on Jun. 28, 2013, in the Korean Intellectual Property Office, the disclosure of which is incorporated herein by reference.

BACKGROUND OF THE INVENTION

1. Field of the Invention

The present invention relates to a light emitting diode power supply apparatus capable of stably supplying power to a light emitting diode.

2. Description of the Related Art

Generally, in order to drive an electronic device in a domestically, commercially, industrially or the like, a power supply apparatus converting commercially-available power into driving power appropriate for an electronic device and supplying the converted driving power is used inside or outside the electronic device.

The power supply apparatus may also be used in order to drive a light emitting diode.

Recently, interest in and demand for light emitting diodes (LEDs) has increased.

A device using the light emitting diode may be manufactured to be compact to thereby be used in a location in which it is difficult to install an existing electronic product. Further, in the case in which the light emitting diode is used as an illumination apparatus, it is easy to implement various colors of light and control illuminance thereof, such that the light emitting diode may be used as a system illumination apparatus appropriate for situations such as watching movies, reading, conferencing, or the like.

In addition, the light emitting diode consumes an amount of power corresponding to ⅛ of the power consumed by an incandescent lamp, has a lifespan of fifty thousand to one hundred thousand hours, 5 to 10 times larger than that of the incandescent lamp, and is environment-friendly as a mercury free light source and may be variously designed.

Due to these characteristics, light emitting diode illumination projects have been promoted as national projects in many nations such as America, Japan, Australia, as well as Korea.

As described above, light emitting diodes require a power supply apparatus supplying power for driving the light emitting diode as disclosed in the following Related Art Document.

Meanwhile, a light emitting diode may be used in a flat panel display apparatus of which a size has increased. Alight emitting diode power supply apparatus used in the display apparatus is switched depending on a pulse width modulation (PWM) signal to supply power. In the case in which the PWM signal is not generated for a long period of time, a voltage supplied to the light emitting diode may continuously rise, making current regulation of the power supplied to the light emitting diode unstable, such that the light emitting diode may not be normally driven.

RELATED ART DOCUMENT (Patent Document 1) Korean Patent Laid-Open Publication No. 10-2012-0031215

SUMMARY OF THE INVENTION

An aspect of the present invention provides a light emitting diode power supply apparatus capable of limiting a rise in a voltage level of a power supplied to a light emitting diode even in the case in which driving of the light emitting diode is stopped for a long period of time.

According to an aspect of the present invention, there is provided a light emitting diode power supply apparatus including: a power supply unit supplying a driving power set under a control to a light emitting diode; and a controlling unit selecting one of a detection voltage obtained by detecting a current flowing to the light emitting diode and a voltage provided according to an operation state of the light emitting diode to control a power supply operation of the power supply unit.

The light emitting diode power supply apparatus may further include a feedback voltage forming unit detecting the driving power of the power supply unit to form a feedback voltage.

The voltage provided may be one of the feedback voltage of the feedback voltage forming unit and a fixed voltage having a preset voltage level.

The controlling unit may control the power supply operation of the power supply unit based on the detection voltage during a period in which the light emitting diode is operated and control the power supply operation of the power supply unit based on one of the feedback voltage and the fixed voltage when the operation of the light emitting diode is stopped for a preset time.

The controlling unit may include: a first comparator comparing the detection voltage and a voltage of a dimming signal with each other; a second comparator comparing the feedback voltage and a preset reference voltage with each other; a current mirror mirroring a current according to the comparison result of the first or second comparator to control a frequency of a reference frequency signal required for the power supply operation of the power supply unit; a third comparator comparing a preset operating power and a voltage of the comparison result of the first or second comparator with each other to control the current mirroring of the current mirror; and a buffer buffering the comparison result input thereinto.

The controlling unit may further include: a first switch switching an output of the comparison result of the first comparator according to a preset pulse width modulation (PWM) reset signal; and a second switch switching an output of the comparison result of the second comparator according to a preset reset signal.

The controlling unit may further include: a setter setting an output condition of the comparison results of the first and second comparators; and a multiplexer outputting the comparison result of the first or second comparator according to the output condition set by the setter.

The controlling unit may further include: a first multiplexer selecting and outputting one of the comparison result of the first comparator and a preset fixed voltage according to a preset abnormal operation condition; and a second multiplexer selecting one of the output of the first multiplexer and the comparison result of the second comparator according to a voltage level of the feedback voltage to be provided to the buffer.

The controlling unit may further include a selector selecting and outputting a comparison result having a lower voltage level in the comparison results of the first and second comparators in the case in which a preset abnormal operation condition is satisfied.

The controlling unit may include: a first comparator comparing the detection voltage and a voltage of a dimming signal with each other; a first switch switching an output of the comparison result of the first comparator according to a preset PWM reset signal; a setter setting an output condition; a multiplexer outputting the comparison result of the first comparator or a preset fixed voltage according to the output condition set by the setter; a current mirror mirroring a current according to the output signal of the multiplexer to control a frequency of a reference frequency signal required for the power supply operation of the power supply unit; a third comparator comparing a preset operating power and the output signal of the multiplexer with each other to control the current mirroring of the current mirror; and a buffer buffering the output signal of the multiplexer.

The light emitting diode power supply may further include a transferring unit electrically insulated to transfer a control signal of the controlling unit to the power supply unit.

According to another aspect of the present invention, there is provided a light emitting diode power supply apparatus including: a power supply unit switching an input power to supply a driving power to a light emitting diode; and a controlling unit selecting one of a detection voltage obtained by detecting a current flowing to the light emitting diode and a voltage provided according to an operation state of the light emitting diode to control a power supply operation of the power supply unit.

The power supply unit may include: a switching unit switching the input power under a control of the controlling unit; a transforming unit transforming the power switched by the switching unit; and a first outputting unit stabilizing the power transformed by the transforming unit to output the driving power.

The transforming unit may include a primary winding receiving the switched power, a first secondary winding magnetically coupled to the primary winding to transform the switched power according to a preset turns ratio and transferring the transformed power to the first outputting unit, and a second secondary winding magnetically coupled to the primary winding to transform the switched power according to a preset turns ratio.

The power supply unit may further include a second outputting unit stabilizing a power from the second secondary winding to output a preset power.

The transforming unit may further include an inductor-inductor-capacitor (LLC) resonance tank.

The power supply unit may further include: a filter unit removing electromagnetic interference of an alternating current (AC) power; and a power factor correcting unit correcting a power factor of the power filtered by the filter unit and transferring the power of which the power factor is corrected to the switching unit.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE EMBODIMENTS

Figure 1:
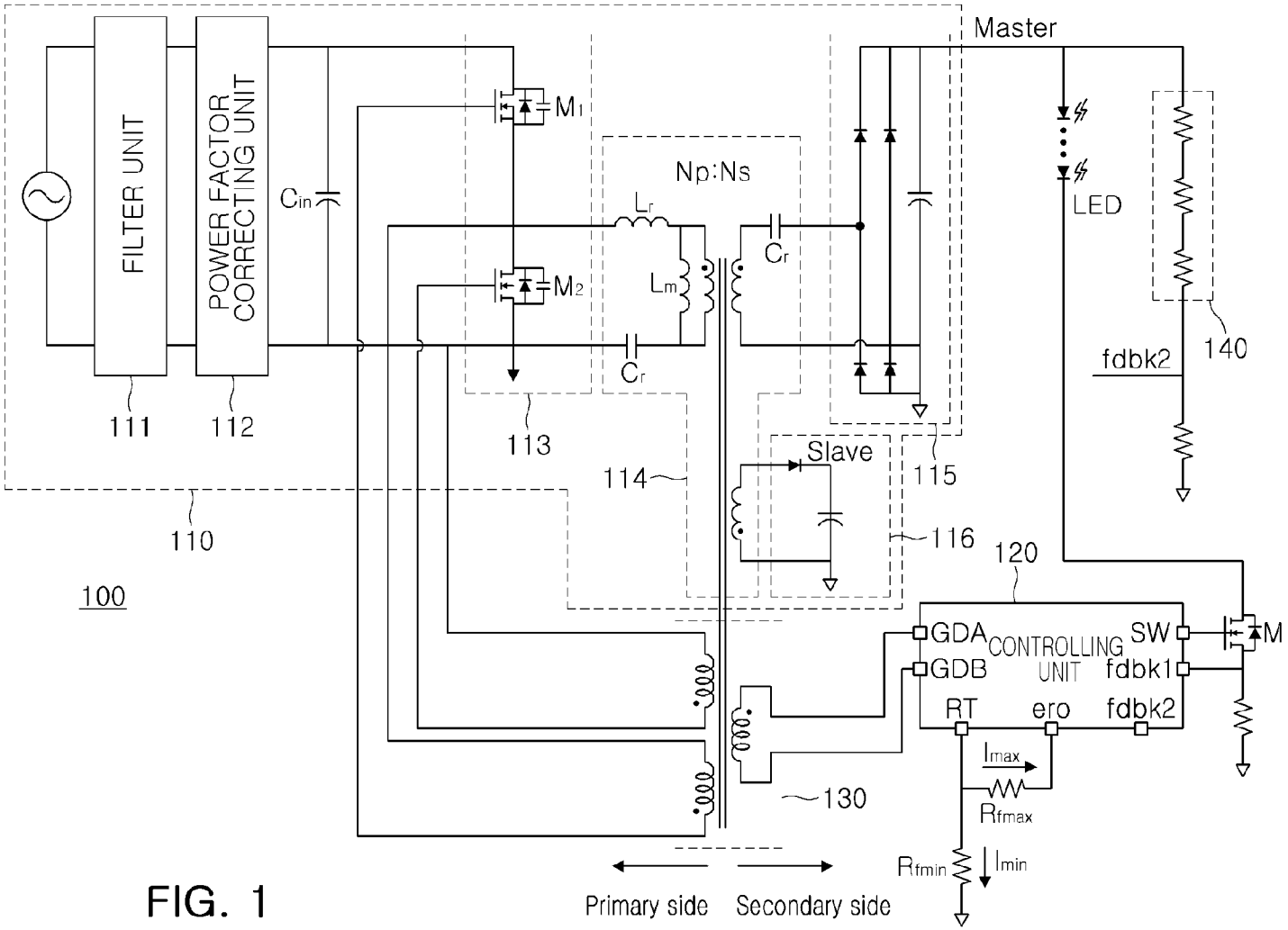
FIG. 1 is a schematic circuit diagram of a light emitting diode power supply apparatus according to an embodiment of the present invention.

Hereinafter, embodiments of the present invention will be described in detail. The invention may, however, be embodied in many different forms and should not be construed as being limited to the embodiments set forth herein. Rather, these embodiments are provided so that this disclosure will be thorough and complete, and will fully convey the scope of the invention to those skilled in the art. Throughout the drawings, the same or like reference numerals will be used to designate the same or like elements.

FIG. 1 is a schematic circuit diagram of a light emitting diode power supply apparatus according to an embodiment of the present invention.

Referring to FIG. 1, the light emitting diode power supply apparatus 100 according to the embodiment of the present invention may include a power supply unit 110, a controlling unit 120, a transferring unit 130, and a feedback voltage forming unit 140.

The power supply unit 110 may include a filter unit 111, a power factor correcting unit 112, a switching unit 113, a transforming unit 114, a first outputting unit 115, and a second outputting unit 116.

The filter unit 111 may filter electromagnetic interference of an alternating current (AC) power, and the power factor correcting unit 112 may adjust a phase difference between a voltage and a current of the filtered power to correct a power factor.

The switching unit 113 may switch the power of which the power factor is corrected under a control of the controlling unit 120. To this end, the switching unit 113 may include a half bridge switch including two switches M1 and M2. The above-mentioned switching unit 113 may switch the power of which the power factor is corrected in an inductor-inductor-capacitor (LLC) resonance scheme, and the transforming unit 114 may have an LLC resonant tank Lr, Lm, and Cr and include a transformer having a preset turns ratio (Np:Ns). The transformer may include a primary winding receiving the power switched by the switching unit 113 and first and second secondary windings magnetically coupled to the primary winding to form a turns ratio and transforming and outputting the switched power according to the turns ratio, respectively.

The first outputting unit 115 may stabilize the power from the first secondary winding to supply a driving power to a light emitting diode LED, and the second outputting unit 116 may stabilize the power from the second secondary winding to output a preset power. The power from the second outputting unit 116 may be used for driving the light emitting diode LED.

The controlling unit 120 may control the switching of the power by the switching unit 113 and the driving of the light emitting diode LED.

To this end, the controlling unit 120 may control the switching of the power by the switching unit 113 based on a detection voltage fdbk1 obtained by detecting a current flowing to the light emitting diode LED. To this end, the controlling unit 120 may provide control signals GDA and GDB to the switches M1 and M2 of the switching unit 113. Since the controlling unit 120 may be formed on a secondary side and the switching unit 113 may be formed on a primary side electrically insulated from the secondary side, the control signals GDA and GDB of the controlling unit 120 may be transferred to the switches M1 and M2 of the switching unit 113 through the transferring unit 130 at which the primary side and the second side are electrically insulated from each other.

In addition, the controlling unit 120 may control switching of the switch M to adjust a current flowing to the light emitting diode LED and stop the driving of the light emitting diode LED for a long period of time in some cases. In this case, the detection voltage fdbk1 becomes '0' and an LLC gain of the switching unit 113 is increased, such that a voltage level of the driving power supplied to the light emitting diode LED may continuously rise.

In order to solve this problem, a feedback voltage forming unit 140 may be connected in parallel with the light emitting diode LED.

The feedback voltage forming unit 140 may detect the driving power supplied to the light emitting diode LED and provide a feedback voltage fdbk2 to the controlling unit 120, and the controlling unit 120 may control the switching operation of the switching unit 113 based on the feedback voltage fdbk2 to limit a rise in the voltage level of the driving power supplied to the light emitting diode LED.

A more detailed description thereof will be provided below with reference to FIGS. 2 through 6.

FIGS. 2 through 6 are circuit diagrams schematically showing various examples of a controlling unit used in the light emitting diode power supply apparatus according to the embodiment of the present invention.

Figure 2:
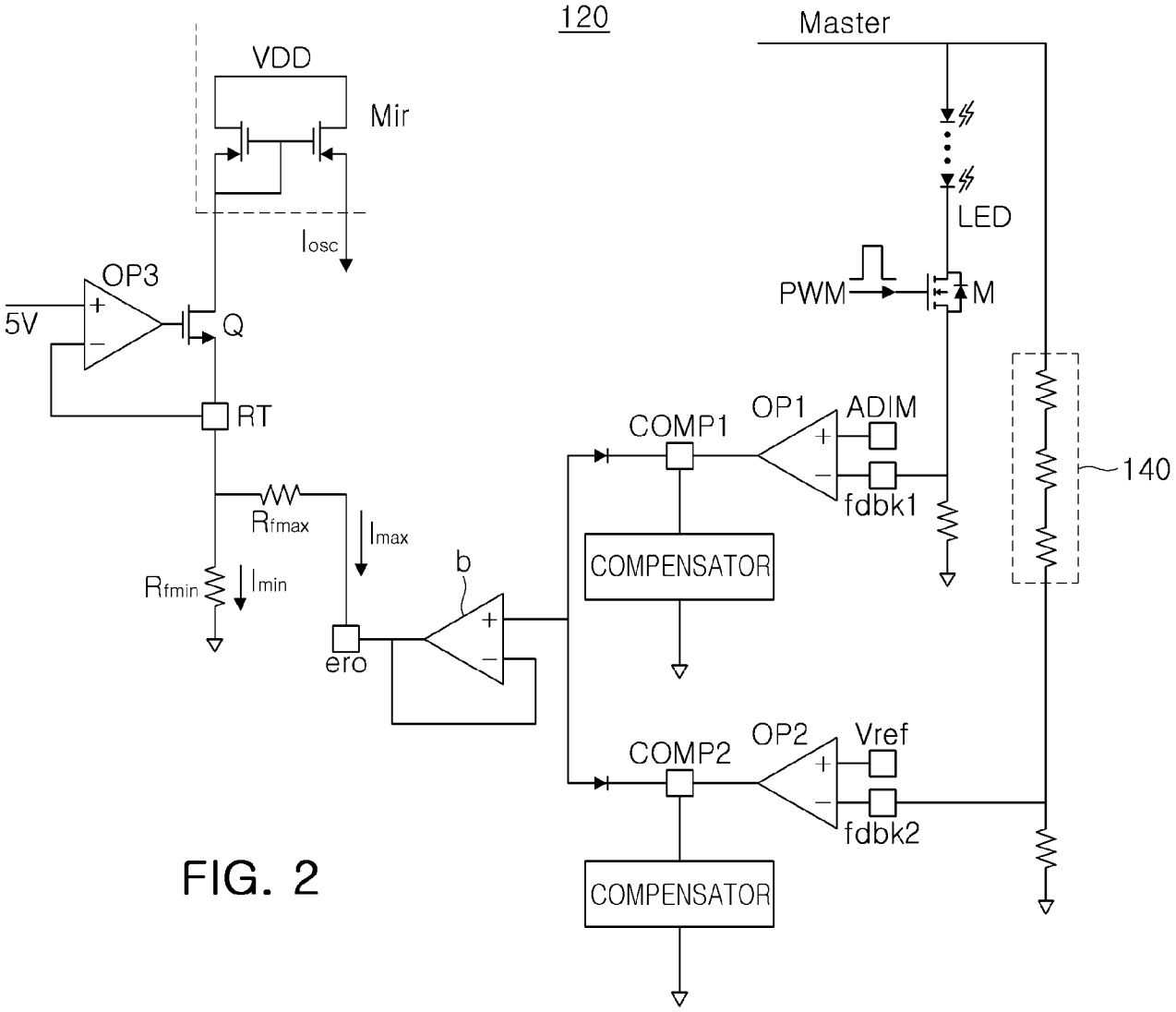
FIGS. 2 through 6 are circuit diagrams schematically showing various examples of a controlling unit used in the light emitting diode power supply apparatus according to the embodiment of the present invention.

First referring to FIG. 2, the controlling unit 120 used in the light emitting diode power supply apparatus according to the embodiment of the present invention may include a first comparator op1, a second comparator op2, a buffer b, a third comparator op3, a switch Q, and a current mirror Mir.

The first comparator op1 may compare a dimming signal ADIM controlling brightness of the light emitting diode LED and the detection voltage fdbk1 with each other to output the comparison result, the second comparator op2 may compare a preset reference voltage Vref and the feedback voltage fdbk2 with each other to output the comparison result. The comparison results of the first and second comparators op1 and op2 may be voltage- or current-compensated for by compensators, respectively, and a comparison result having a low voltage level in the comparison results of the first and second comparators op1 and op2 may be transferred to the buffer b by reverse connection in which each output terminal of the first and second comparators is connected to a cathode of a diode and the buffer b is connected to an anode of the diode. The buffer b may buffer and output the received comparison result, the third comparator op3 may compare a voltage obtained by detecting a current generated by the buffer b with a reference voltage (for example, 5V) and switch the switch Q according to the comparison result, and current Imin and Imax by the switching operation of the switch Q may be mirrored by the current mirror Mir to control a frequency of a frequency signal Isoc controlling frequencies of the control signals GDA and GDB controlling the switching operation of the switching unit 113.

Therefore, the first comparator op1 may be a component for a current loop control operation, the second comparator op2 may be a component for a voltage loop control operation, a current loop may be mainly operated at the time of a normal operation, thereby smoothly controlling the switching operation of the switching unit 113, and a voltage loop may be operated in the case in which an operation of the light emitting diode LED is stopped for a preset time, thereby limiting the voltage level of the driving power supplied to the light emitting diode LED to rise to a predetermined voltage or more. Here, the preset time may be, for example, 10 msec or more in which a zero dimming or no-load situation is continued, and be variously set.

Figure 3:
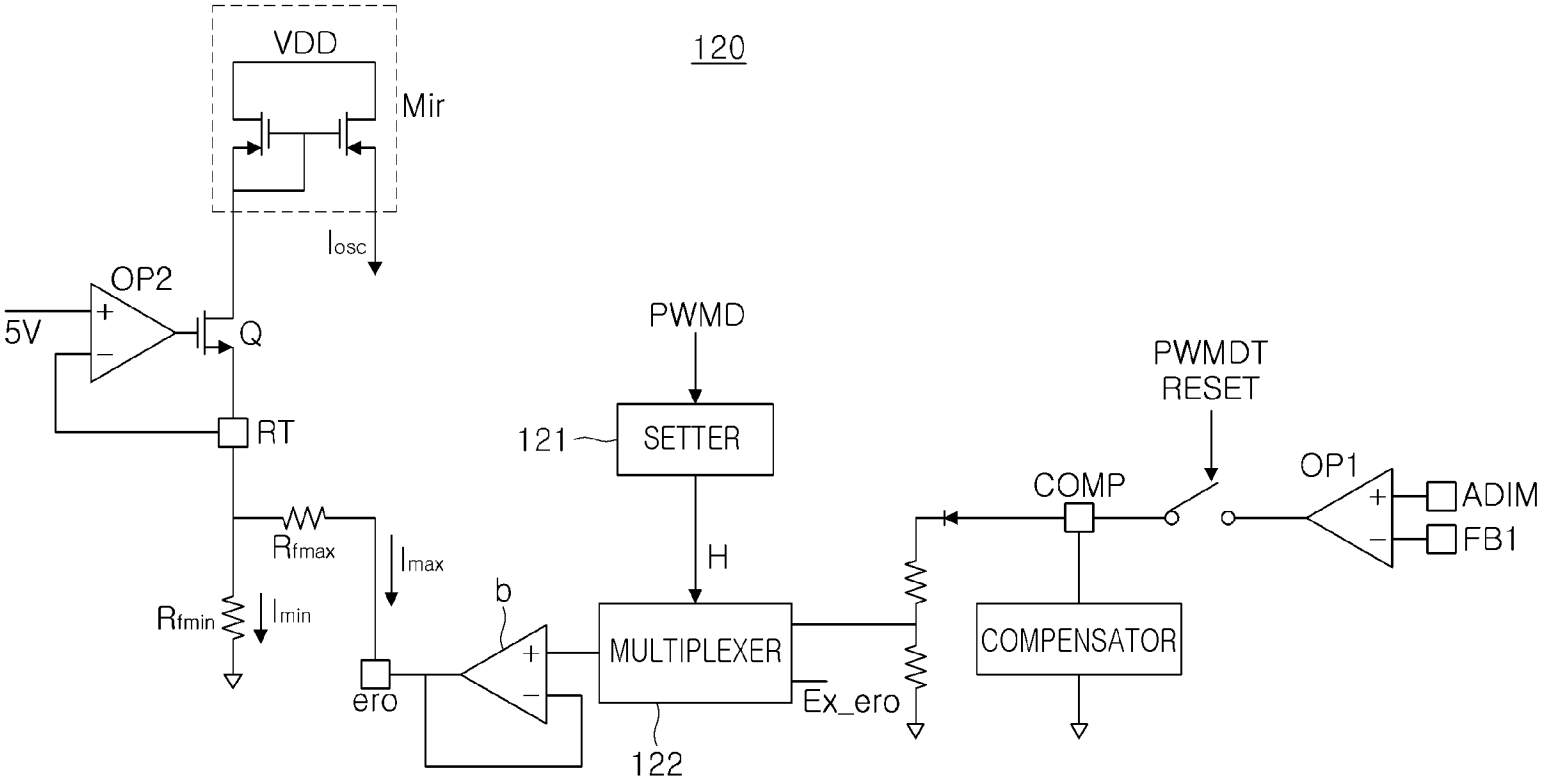

Referring to FIG. 3, the controlling unit 120 used in the light emitting diode power supply apparatus according to the embodiment of the present invention may include a first comparator op1, a buffer b, a third comparator op3, a switch Q, a current mirror Mir, a setter 121, and a multiplexer 122.

Hereinafter a detailed description of components the same as those of FIG. 2 will be omitted.

The setter 121 may set an output condition of the multiplexer 122. Here, an example of the output condition may include the case in which a zero dimming or no-load situation is continued for 10 msec or more. In this case, the multiplexer 122 may output a preset fixed voltage Ex_ero. Therefore, the preset fixed voltage Ex_ero may be output to secure a margin of the switching frequency, thereby solving a problem that in the case in which the zero dimming is continued for several seconds, a switching frequency becomes rapid to decrease a switching duty ratio, such that regulation of the power of the second outputting unit 116 is not maintained. A comparison result of the first comparator op1 may be blocked by a first switch switching an output path by a preset pulse width modulation (PWM) reset signal.

Figure 4:
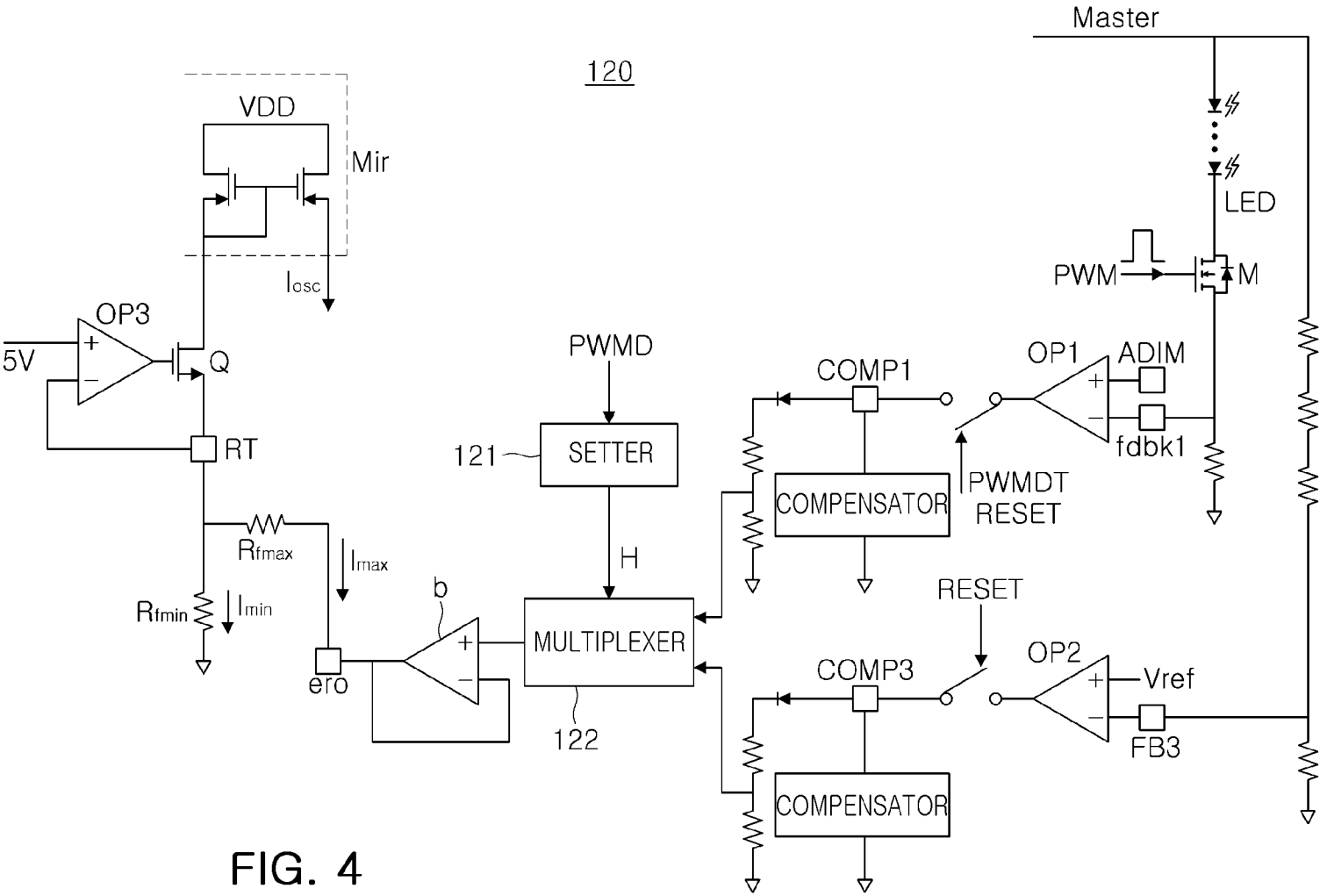

Referring to FIG. 4, the setter 121 may allow the multiplexer 122 to output a comparison result of the second comparator op2 to perform the voltage loop control operation in the case in which the zero dimming or no-load situation is continued for 10 msec or more, thereby solving the problem that in the case in which the zero dimming is continued for several seconds, the switching frequency becomes rapid to decrease the switching duty ratio, such that the regulation of the power of the second outputting unit 116 is not maintained.

Figure 5:
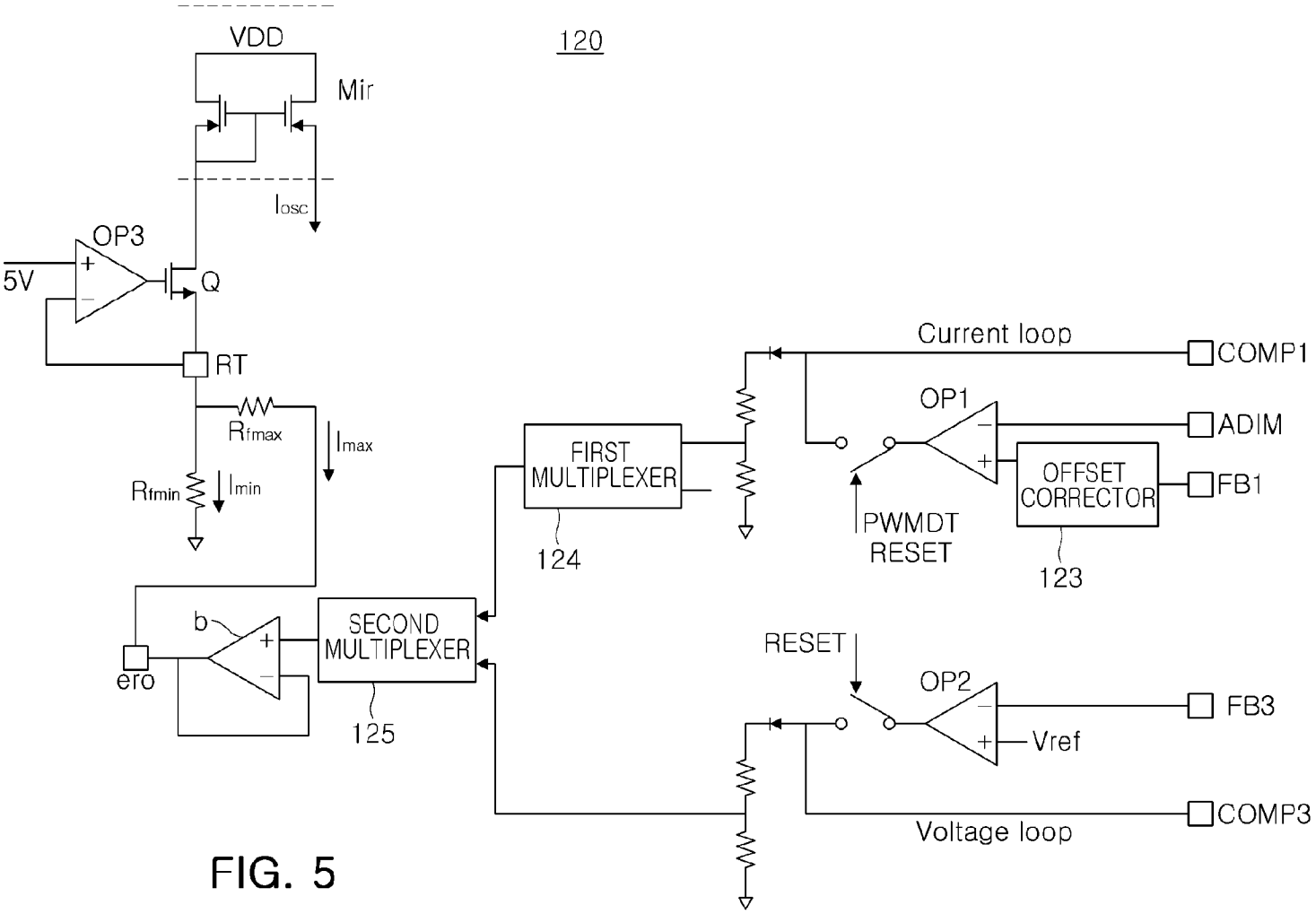

Referring to FIG. 5, the controlling unit 120 used in the light emitting diode power supply apparatus according to the embodiment of the present invention may include first and second multiplexers 124 and 125, wherein the first multiplexer 124 may select and output a preset fixed voltage (for example, 2.5V) in the case in which the zero dimming or no-load situation is continued for 10 msec or more or in the case in which a voltage level of the driving power is in a preset abnormal operation state and the second multiplexer 125 may select the comparison result of the second comparator op2 and transfer the selected comparison result to the buffer b in the case in which the voltage level of the driving power is a preset voltage level or more.

An output of the comparison results of the first and second comparators op1 and op2 may be blocked by switching operations of first and second switches, respectively, wherein the first switch may perform the switching operation by a preset PWM reset signal and the second switch may perform the switching operation by a preset reset signal.

An offset corrector 123 may correct an offset of the dimming signal ADIM provided to the first comparator op1.

Figure 6:
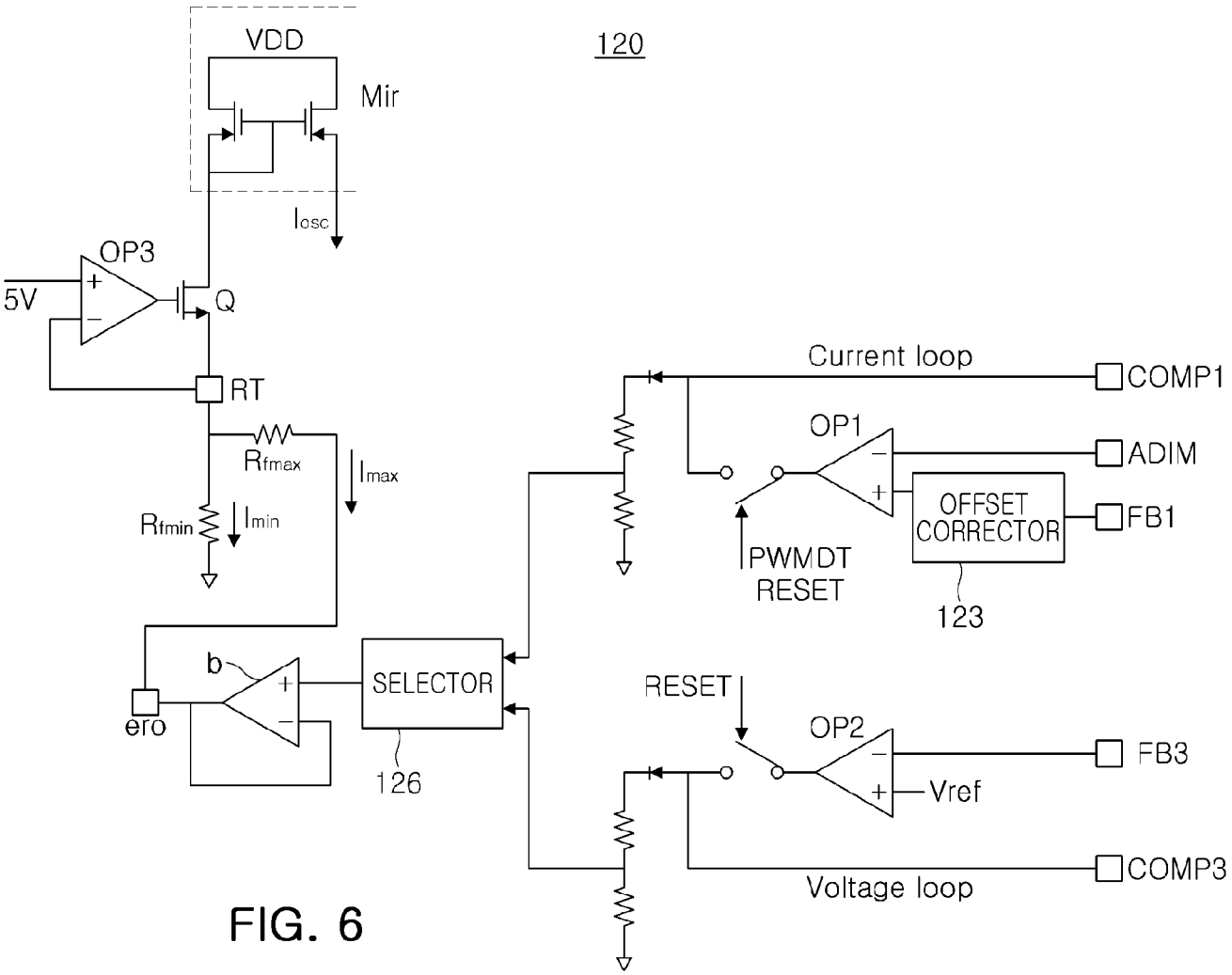

Referring to FIG. 6, the controlling unit 120 used in the light emitting diode power supply apparatus according to the embodiment of the present invention may include a selector 126. Here, in the case in which the zero dimming or no-load situation is continued for 10 msec or more or in the case in which the voltage level of the driving power is in a preset abnormal operation state, the dimming signal ADIM falls to a low level and the detection voltage FB1 becomes '0 ', such that a compensator COMP1 may be charged with a comparison result of the first comparator op1 . Therefore, an LLC gain of the switching unit 113 is increased, such that the voltage level of the driving power may rise. Accordingly, as a feedback voltage FB3 is increased, a compensator COMP3 discharges a comparison result of the second comparator op2, such that a voltage level of the comparison result of the first comparator op1 may become higher than that of the comparison result of the second comparator op2 , and the selector 126 may select and output the comparison result having a lower voltage level, thereby allowing the voltage loop control operation to be performed.

Figure 7:
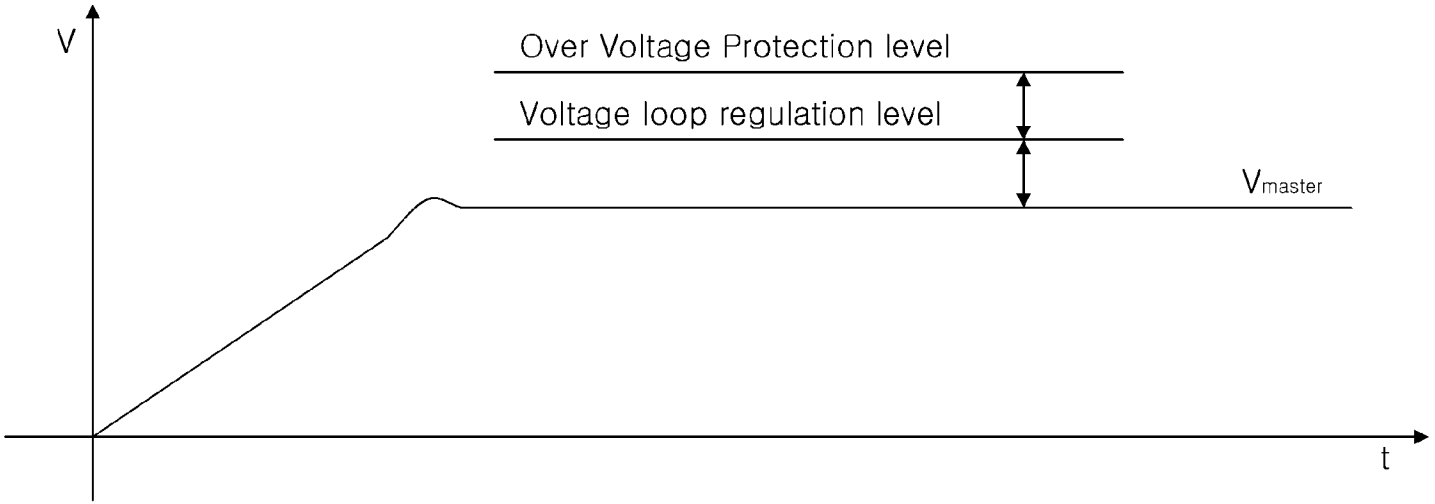
FIG. 7 is a graph showing electrical characteristics of the light emitting diode power supply apparatus according to the embodiment of the present invention.

FIG. 7 is a graph showing electrical characteristics of the light emitting diode power supply apparatus according to the embodiment of the present invention.

Referring to FIG. 7, it may be seen that the voltage level of the driving power Vmaster supplied to the light emitting diode LED of the light emitting diode power supply apparatus according to the embodiment of the present invention is limited to a voltage loop regulation level or less. Preferably, the voltage loop regulation level may be set to an over-voltage protection level or less.

As set forth above, according to the embodiment of the present invention, even in the case in which the driving of the light emitting diode is stopped for a long period of time, a separate feedback signal is received to limit a rise in the voltage level of the power supplied to the light emitting diode, such that even in the case in which the light emitting diode is driven after the driving of the light emitting diode is stopped for a long period of time, current regulation is maintained, whereby the light emitting diode may be stably driven.

While the present invention has been shown and described in connection with the embodiments, it will be apparent to those skilled in the art that modifications and variations can be made without departing from the spirit and scope of the invention as defined by the appended claims.

What is claimed is:

1. A light emitting diode power supply apparatus comprising:

a power supply unit supplying a driving power set under a control to a light emitting diode; and a controlling unit controlling power supply operation of the power supply unit based on a detection voltage obtained by detecting a current flowing to the light emitting diode during a period in which the light emitting diode is operated and controlling the power supply operation of the power supply unit based on a voltage provided, when the operation of the light emitting diode is stopped.

2. The light emitting diode power supply apparatus of claim 1, further comprising a feedback voltage forming unit detecting the driving power of the power supply unit to form a feedback voltage.

3. The light emitting diode power supply apparatus of claim 2, wherein the voltage provided is one of the feedback voltage detected by the feedback voltage forming unit and a fixed voltage having a preset voltage level.

4. The light emitting diode power supply apparatus of claim 2, wherein the controlling unit includes:

a first comparator comparing the detection voltage and a voltage of a dimming signal with each other;

a second comparator comparing the feedback voltage and a preset reference voltage with each other;

a current mirror mirroring a current according to the comparison result of the first or second comparator to control a frequency of a reference frequency signal required for the power supply operation of the power supply unit;

a third comparator comparing a preset operating power and a voltage of the comparison result of the first or second comparator with each other to control the current mirroring of the current mirror; and a buffer buffering the comparison result input thereinto.

5. The light emitting diode power supply apparatus of claim 4, wherein the controlling unit further includes:

a first switch switching an output of the comparison result of the first comparator according to a preset pulse width modulation (PWM) reset signal; and a second switch switching an output of the comparison result of the second comparator according to a preset reset signal.

6. The light emitting diode power supply apparatus of claim 5, wherein the controlling unit further includes:

a setter setting an output condition of the comparison results of the first and second comparators; and a multiplexer outputting the comparison result of the first or second comparator according to the output condition set by the setter.

7. The light emitting diode power supply apparatus of claim 5, wherein the controlling unit further includes:

a first multiplexer selecting and outputting one of the comparison result of the first comparator and a preset fixed voltage according to a preset abnormal operation condition; and a second multiplexer selecting one of the output of the first multiplexer and the comparison result of the second comparator according to a voltage level of the feedback voltage to be provided to the buffer.

8. The light emitting diode power supply apparatus of claim 5, wherein the controlling unit further includes a selector selecting and outputting a comparison result having a lower voltage level in the comparison results of the first and second comparators in the case in which a preset abnormal operation condition is satisfied.

9. The light emitting diode power supply apparatus of claim 1, wherein the controlling unit includes:

a first comparator comparing the detection voltage and a voltage of a dimming signal with each other;

a first switch switching an output of the comparison result of the first comparator according to a preset PWM reset signal;

a setter setting an output condition;

a multiplexer outputting the comparison result of the first comparator or a preset fixed voltage according to the output condition set by the setter;

a current mirror mirroring a current according to the output signal of the multiplexer to control a frequency of a reference frequency signal required for the power supply operation of the power supply unit;

a third comparator comparing a preset operating power and the output signal of the multiplexer with each other to control the current mirroring of the current mirror; and a buffer buffering the output signal of the multiplexer.

10. The light emitting diode power supply apparatus of claim 1, further comprising a transferring unit electrically insulated to transfer a control signal of the controlling unit to the power supply unit.

11. A light emitting diode power supply apparatus comprising:

a power supply unit switching an input power to supply a driving power to a light emitting diode; and a controlling unit controlling a power supply operation of the power supply unit based on a detection voltage obtained by detecting a current flowing to the light emitting diode during a period in which the light emitting diode is operated and controlling the power supply operation of the power supply unit based on a voltage provided, when the operation of the light emitting diode is stopped.

12. The light emitting diode power supply apparatus of claim 11, further comprising a feedback voltage forming unit detecting the driving power of the power supply unit to form a feedback voltage.

13. The light emitting diode power supply apparatus of claim 12, wherein the voltage provided is one of the feedback voltage detected by the feedback voltage forming unit and a fixed voltage having a preset voltage level.

14. The light emitting diode power supply apparatus of claim 12, wherein the controlling unit includes:

a first comparator comparing the detection voltage and a voltage of a dimming signal with each other;

a second comparator comparing the feedback voltage and a preset reference voltage with each other;

a current mirror mirroring a current according to the comparison result of the first or second comparator to control a frequency of a reference frequency signal required for the power supply operation of the power supply unit;

a third comparator comparing a preset operating power and a voltage of the comparison result of the first or second comparator with each other to control the current mirroring of the current mirror; and a buffer buffering the comparison result input thereinto.

15. The light emitting diode power supply apparatus of claim 14, wherein the controlling unit further includes:

a first switch switching an output of the comparison result of the first comparator according to a preset PWM reset signal; and a second switch switching an output of the comparison result of the second comparator according to a preset reset signal.

16. The light emitting diode power supply apparatus of claim 15, wherein the controlling unit further includes:

a setter setting an output condition of the comparison results of the first and second comparators; and a multiplexer outputting the comparison result of the first or second comparator according to the output condition set by the setter.

17. The light emitting diode power supply apparatus of claim 15, wherein the controlling unit further includes:

a first multiplexer selecting and outputting one of the comparison result of the first comparator and a preset fixed voltage according to a preset abnormal operation condition; and a second multiplexer selecting one of the output of the first multiplexer and the comparison result of the second comparator according to a voltage level of the feedback voltage to be provided to the buffer.

18. The light emitting diode power supply apparatus of claim 15, wherein the controlling unit further includes a selector selecting and outputting a comparison result having a lower voltage level in the comparison results of the first and second comparators in the case in which a preset abnormal operation condition is satisfied.

19. The light emitting diode power supply apparatus of claim 11, wherein the controlling unit includes:

a first comparator comparing the detection voltage and a voltage of a dimming signal with each other;

a first switch switching an output of the comparison result of the first comparator according to a preset PWM reset signal;

a setter setting an output condition;

a multiplexer outputting the comparison result of the first comparator or a preset fixed voltage according to the output condition set by the setter;

a current mirror mirroring a current according to the output signal of the multiplexer to control a frequency of a reference frequency signal required for the power supply operation of the power supply unit;

a third comparator comparing a preset operating power and the output signal of the multiplexer with each other to control the current mirroring of the current mirror; and a buffer buffering the output signal of the multiplexer.

20. The light emitting diode power supply apparatus of claim 11, wherein the power supply unit includes:

a switching unit switching the input power under a control of the controlling unit;

a transforming unit transforming the power switched by the switching unit; and a first outputting unit stabilizing the power transformed by the transforming unit to output the driving power.

21. The light emitting diode power supply apparatus of claim 20, wherein the transforming unit includes a primary winding receiving the switched power, a first secondary winding magnetically coupled to the primary winding to transform the switched power according to a preset turns ratio and transferring the transformed power to the first outputting unit, and a second secondary winding magnetically coupled to the primary winding to transform the switched power according to a preset turns ratio.

22. The light emitting diode power supply apparatus of claim 21, wherein the power supply unit further includes a second outputting unit stabilizing a power from the second secondary winding to output a preset power.

23. The light emitting diode power supply apparatus of claim 21, wherein the transforming unit further includes an inductor-inductor-capacitor (LLC) resonance tank.

24. The light emitting diode power supply apparatus of claim 11, wherein the power supply unit further includes:

a filter unit removing electromagnetic interference of an alternating current (AC) power; and a power factor correcting unit correcting a power factor of the power filtered by the filter unit and transferring the power of which the power factor is corrected to the switching unit.

25. The light emitting diode power supply apparatus of claim 11, further comprising a transferring unit electrically insulated to transfer a control signal of the controlling unit to the power supply unit.

* * * * *